US011043769B2

(12) United States Patent
Kameyama et al.

(10) Patent No.: US 11,043,769 B2
(45) Date of Patent: Jun. 22, 2021

(54) COMBINED INNER HOUSING CONNECTOR FOR VEHICLE

(71) Applicants: Yazaki Corporation, Tokyo (JP); SMK CORPORATION, Tokyo (JP)

(72) Inventors: Isao Kameyama, Shizuoka (JP); Tomohiro Imamura, Tokyo (JP); Shogo Uehara, Tokyo (JP); Yasuo Yoshiura, Tokyo (JP); Shuichi Uruwashi, Tokyo (JP); Shinya Okumura, Tokyo (JP)

(73) Assignees: YAZAKI CORPORATION, Tokyo (JP); SMK CORPORATION, Tokyo (JP)

( * ) Notice: Subject to any disclaimer, the term of this patent is extended or adjusted under 35 U.S.C. 154(b) by 0 days.

(21) Appl. No.: 16/788,842

(22) Filed: Feb. 12, 2020

(65) Prior Publication Data

US 2020/0274278 A1 Aug. 27, 2020

(30) Foreign Application Priority Data

Feb. 27, 2019 (JP) ..... JP2019-033731

(51) Int. Cl.
*H01R 13/42* (2006.01)
*H01R 13/502* (2006.01)
(Continued)

(52) U.S. Cl.
CPC ..... *H01R 13/42* (2013.01); *H01R 13/502* (2013.01); *H01R 13/6463* (2013.01);
(Continued)

(58) Field of Classification Search
CPC .. H01R 13/42; H01R 13/502; H01R 13/6463; H01R 13/6585; H01R 13/659; H01R 2107/00; H01R 2201/26
See application file for complete search history.

(56) References Cited

U.S. PATENT DOCUMENTS 7,677,936 B2 * 3/2010 Sato ..... H01R 13/506 439/892
10,033,140 B2 * 7/2018 Kanda ..... H01R 4/184
(Continued)

FOREIGN PATENT DOCUMENTS

JP 2018092801 A 6/2018
JP 2018-152215 A 9/2018

*Primary Examiner* — Abdullah A Riyami
*Assistant Examiner* — Nader J Alhawamdeh
(74) *Attorney, Agent, or Firm* — Sughrue Mion, PLLC

(57) ABSTRACT

A first inner housing and a second inner housing are combined to form a combined inner housing, in which the first inner housing having a plurality of mutually independent insertion holes is formed of a first dielectric or an electric conductor, and the second inner housing having a plurality of mutually independent terminal-housing chambers is formed of a second dielectric. Terminals of a twisted-pair cable are inserted and housed one-to-one in the terminal-housing chambers of the combined inner housing. The twist-released sections of sheathed cables of the twisted-pair cable are inserted and housed one-to-one in the insertion holes of the combined inner housing. The combined inner housing is covered with a shield member, and the combined inner housing and the shield member are housed in an outer housing.

4 Claims, 5 Drawing Sheets

(51) Int. Cl.
*H01R 13/6585* (2011.01)
*H01R 13/659* (2011.01)
*H01R 13/6463* (2011.01)
*H01R 107/00* (2006.01)

(52) U.S. Cl.
CPC ..... *H01R 13/659* (2013.01); *H01R 13/6585* (2013.01); *H01R 2107/00* (2013.01); *H01R 2201/26* (2013.01)

(56) References Cited

U.S. PATENT DOCUMENTS

| | | | | |
|---|---|---|---|---|
| 10,069,269 | B2 * | 9/2018 | Takahashi | H01R 13/6463 |
| 2002/0101041 | A1 * | 8/2002 | Kameyama | H01R 13/521 277/628 |
| 2011/0136391 | A1 * | 6/2011 | Kameyama | H01R 24/60 439/660 |
| 2013/0023154 | A1 * | 1/2013 | Ii | H01R 13/65918 439/607.5 |
| 2013/0288522 | A1 * | 10/2013 | Ii | H01R 13/59 439/607.01 |
| 2015/0295361 | A1 * | 10/2015 | Miyoshi | H01R 13/508 439/607.58 |
| 2018/0026401 | A1 * | 1/2018 | Kan Da | H01R 13/6592 439/607.5 |
| 2018/0048108 | A1 * | 2/2018 | Takahashi | H01R 43/20 |
| 2019/0089099 | A1 * | 3/2019 | Yoshiura | H01R 13/6473 |
| 2020/0274278 | A1 * | 8/2020 | Kameyama | H01R 13/6585 |

* cited by examiner

COMBINED INNER HOUSING CONNECTOR FOR VEHICLE

BACKGROUND

Technical Field

The present disclosure relates to a connector for high-speed transmission for a vehicle.

Related Art

Communications between on-board devices of a motor vehicle or communications between an on-board device and an external device, have been progressively enhanced in speed. A connector has been proposed for a wire harness adaptable to the high-speed communication (Japanese Patent Application Laid-open No. 2018-152215).

The connector includes a terminal unit and a housing for housing the terminal unit. The terminal unit has a first component and a second component. The first component and the second component each are formed of a dielectric. The first component and the second component are mutually combinable. The first component is provided with two terminal-housing chambers comparted by a partition wall and one cable-housing chamber in communication with the two terminal-housing chambers. The two terminal-housing chambers and the one cable-housing chamber are entirely open on the upper side. The first component is combined with the second component, resulting in occlusion of the opening on the upper side of the first component.

Terminals connected with two sheathed cables of a twisted cable are housed one-to-one in the two terminal-housing chambers. The sections in which the twists of the two sheathed cables are released, are housed in the cable-housing chamber.

For the assembly of the terminal unit, the two terminals are inserted through the openings on the upper side of the two terminal-housing chambers of the first component, and the two sheathed cables having the twist released are inserted through the opening on the upper side of the cable-housing chamber. Next, the first component and the second component are assembled into a combination.

SUMMARY

However, according to the previous example, for the assembly of the first component and the second component, because the terminal-housing chambers and the cable-housing chamber of the first component are open on the upper side, the second component is assembled so as to occlude the openings on the upper side.

In this case, because the two sheathed cables having the twist released, have a tendency to twist, the sheathed cables are likely to be pinched (caught) between the contact faces of the first component and the second component. When the first component and the second component are assembled forcibly with the sheathed cables pinched (caught) between the contact faces of the first component and the second component, the core (strand) of each sheathed cable is likely to break.

Thus, the present disclosure has been made in order to solve the issue, and an object of the present disclosure is to provide a connector enabling a sheathed cable to be prevented from being pinched (caught) in cable-housing work.

According to an embodiment of the present disclosure, provided is a connector including:

a combined inner housing formed of a first inner housing and a second inner housing in combination, the first inner housing having a plurality of insertion holes mutually independent, the first inner housing being formed of a first dielectric or an electric conductor, the second inner housing having a plurality of terminal-housing chambers mutually independent, the second inner housing being formed of a second dielectric, the plurality of insertion holes being in one-to-one communication with the plurality of terminal-housing chambers;

a twisted-pair cable having a plurality of sheathed cables, each sheathed cable having a twist released, having an end connected with a terminal, the plurality of terminals being housed one-to-one in the terminal-housing chambers by one-to-one insertion of the terminals in the terminal-housing chambers of the combined inner housing, twist-released sections in which the twists of the sheathed cables are released, being housed one-to-one in the insertion holes by one-to-one insertion of the twist-released sections of the sheathed cables in the insertion holes of the combined inner housing;

a shield member that covers the combined inner housing; and an outer housing that houses the combined inner housing and the shield member.

According to the embodiment of the present disclosure, for cable-housing work, the sheathed cables each connected with the terminal require at least inserting in the mutually independent insertion holes of the combined inner housing. Thus, no pinching (catching) of the sheathed cables occurs in the cable-housing work.

DETAILED DESCRIPTION

Figure 1:
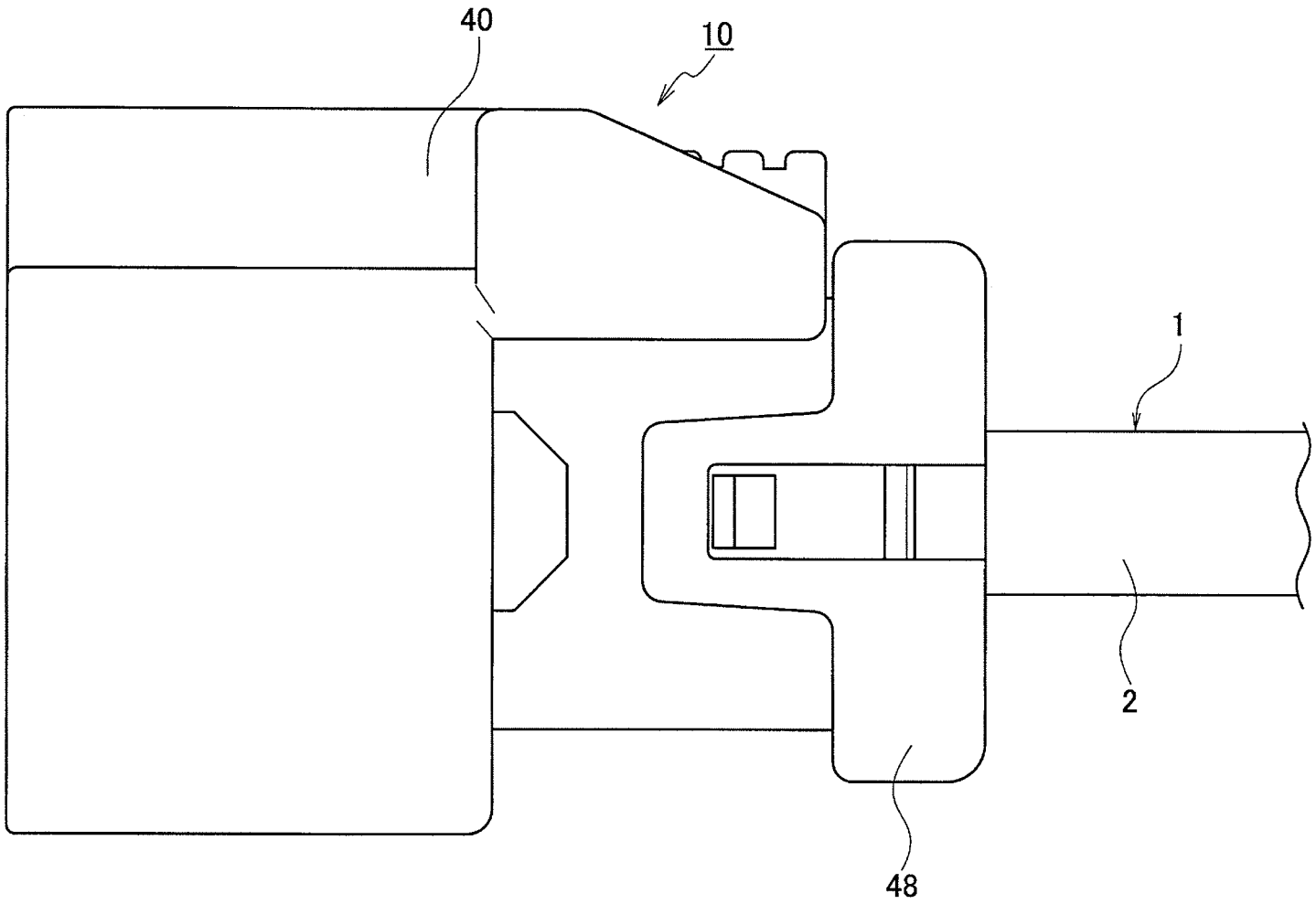
FIG. 1 is a side view of a connector according to an embodiment of the present disclosure.
Figure 2:
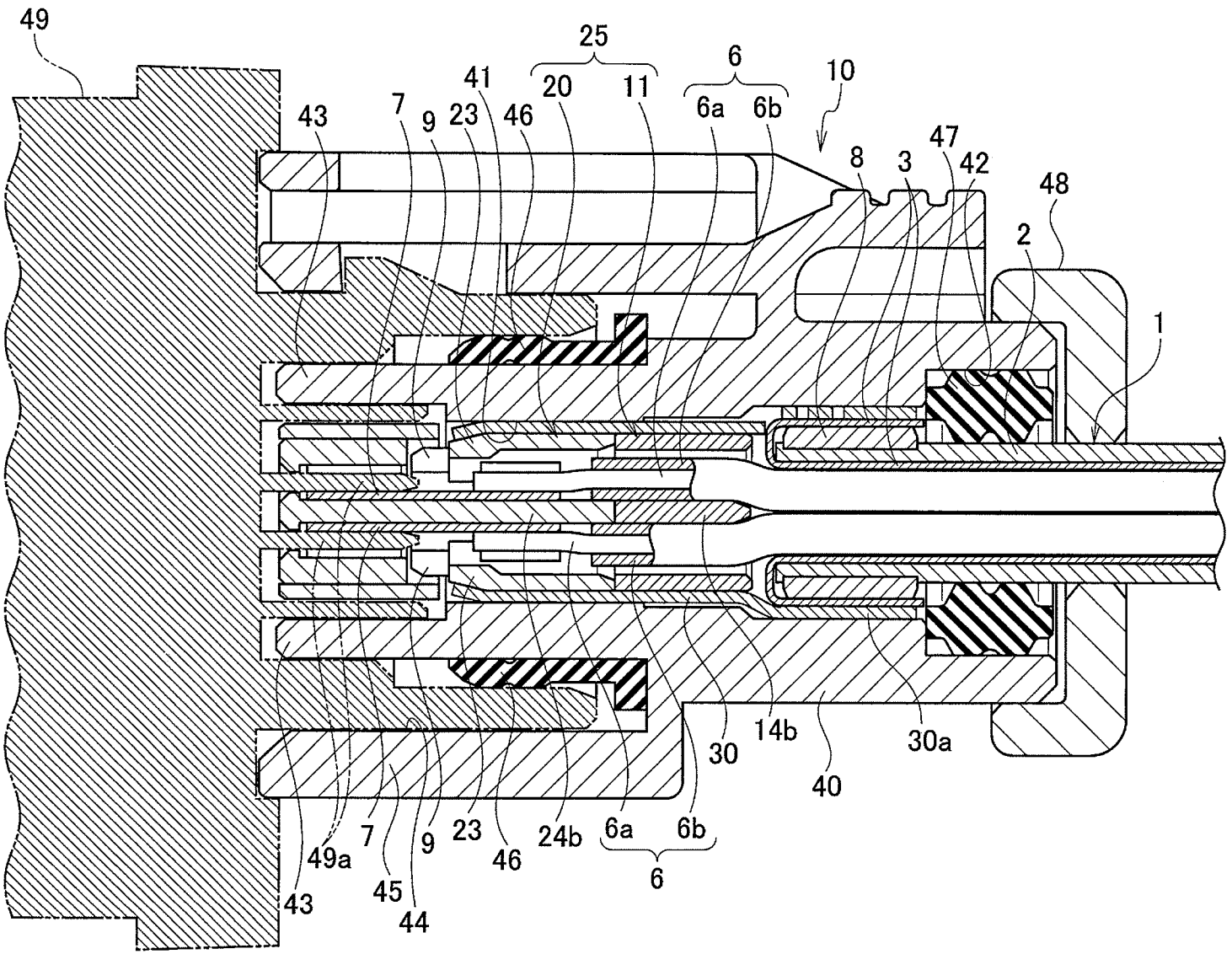
FIG. 2 is a sectional view of the connector according to the embodiment of the present disclosure.
Figure 3:
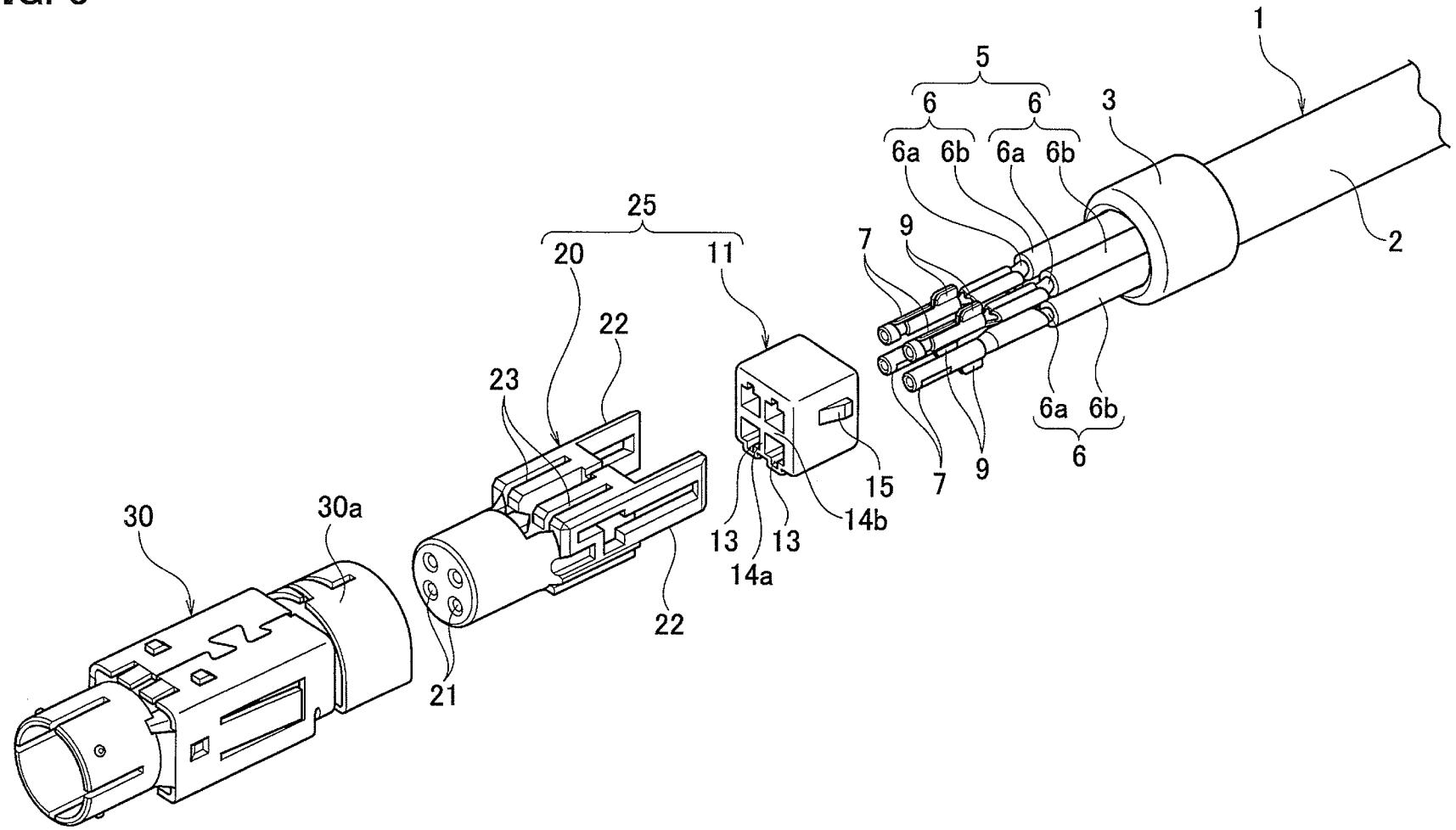
FIG. 3 is a perspective view of a shield member, a first inner housing, a second inner housing, and a twisted cable, according to the embodiment of the present disclosure.
Figure 4:
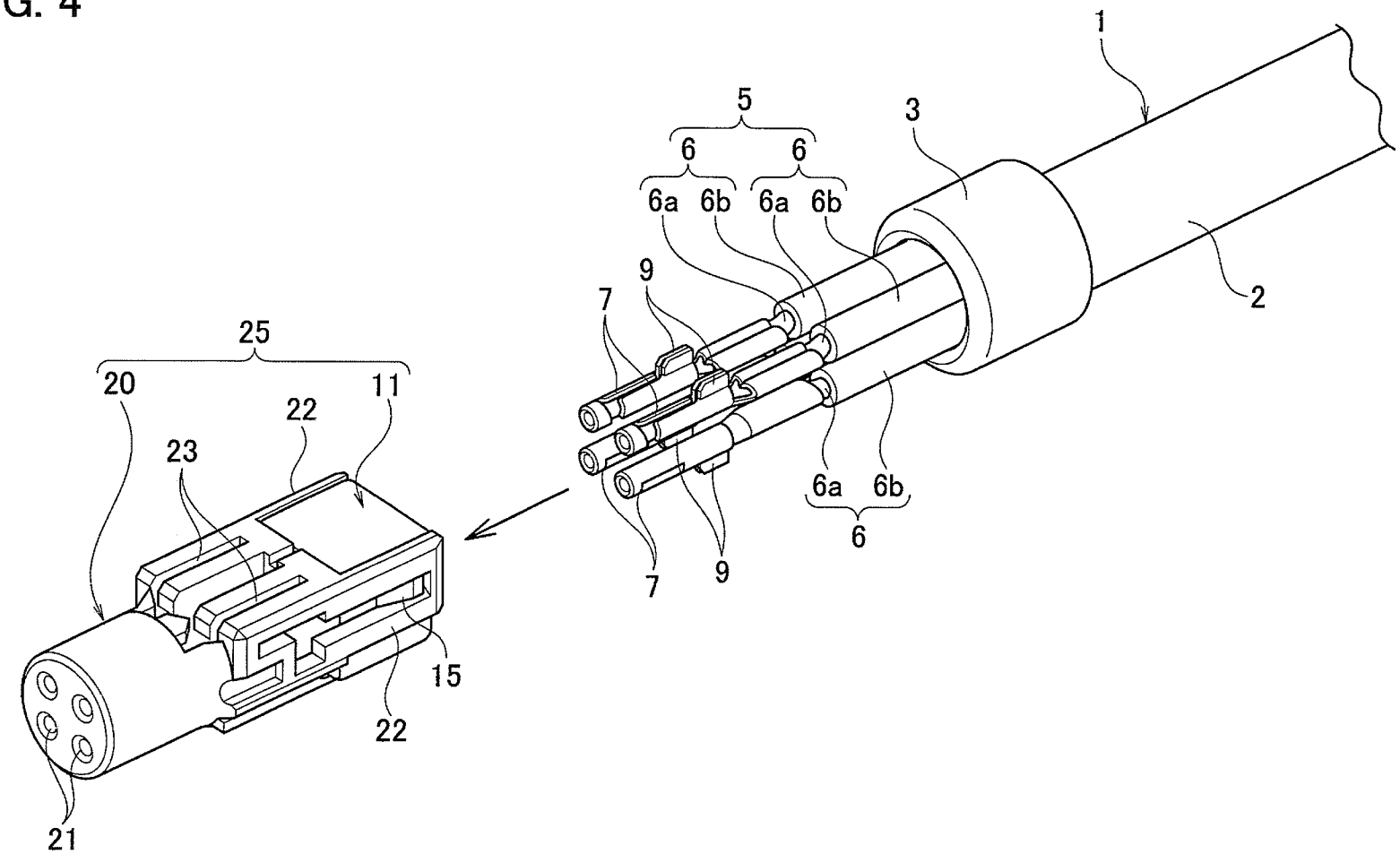
FIG. 4 is a perspective view of a process of insertion of the end portions of twisted-pair cables of the twisted cable into a combined inner housing, according to the embodiment of the present disclosure.

An embodiment of the present disclosure will be described below with reference to the accompanying drawings.

FIGS. 1 to 5 illustrate the embodiment of the present disclosure. A wire harness is a constituent for a high-speed transmission circuit of a motor vehicle. For example, the transmission frequency band thereof is 5 GHz (10 Gbps). The wire harness has a twisted cable 1 and a connector 10 connected with the twisted cable 1.

The twisted cable 1 has a tubular insulating outer sheath 2, a tubular shield braided wire 3 and metallic foil (not illustrated) arranged inside the insulating outer sheath 2, and two twisted-pair cables 5 arranged inside the shield braided wire 3 and the metallic foil (not illustrated). The metallic foil (not illustrated) has an end part cut. The shield braided wire 3 has an end part not cut but folded over a ring 8 arranged on the outer circumferential face of the insulating outer sheath 2.

The two twisted-pair cables 5 each have an end portion exposed outside. Each twisted-pair cable 5 has two sheathed cables 6. Each sheathed cable 6 has a core 6*a* and an insulating outer sheath 6*b* sheathing the outer circumferential side of the core 6*a*.

The two sheathed cables 6 of each twisted-pair cable 5 are twisted together in the section in which the two twisted-pair cables 5 are arranged inside the shield braided wire 3. However, the two sheathed cables 6 of each twisted-pair cable 5 have the twist released in the section in which the two twisted-pair cables 5 are exposed outside. At the end of each of the four sheathed cables 6 having the twist released, the core 6*a* is exposed with the insulating outer sheath 6*b* peeled. Each exposed core 6*a* is connected with a terminal 7 (refer to FIG. 3). At least the four terminals 7 and the twist-released sections in which the twists of the four sheathed cables 6 are released, are housed in the connector 10.

The connector 10 includes a first inner housing 11, a second inner housing 20, a shield member 30, and an outer housing 40.

The first inner housing 11 is formed of a first dielectric (e.g., glass-fiber-containing polybutylene terephthalate) or an electric conductor (e.g., electrically conductive resin (e.g., carbon-containing polybutylene terephthalate)).

The first inner housing 11 has four insertion holes 13 independent in non-communication with each other. The four insertion holes 13 are arranged in two rows vertically and crosswise. Partition walls 14*a* and 14*b* formed of the first dielectric are interposed between each insertion hole 13. The partition wall 14*a* comparts the insertion holes 13 in the crosswise direction, and the partition wall 14*b* comparts the insertion holes 13 in the vertical direction (refer to FIG. 5B).

The first inner housing 11 has a substantially quadrangular block shape. The first inner housing 11 has outer faces in the crosswise direction, provided with a pair of locking protrusions 15.

The second inner housing 20 is formed of a second dielectric (e.g., polybutylene terephthalate).

The second inner housing 20 has four terminal-housing chambers 21 independent in non-communication with each other. The four terminal-housing chambers 21 are arranged in two rows vertically and crosswise, similarly to the insertion holes 13. Partition walls 24*a* and 24*b* formed of the second dielectric are interposed between each adjacent terminal-housing chamber 21. The partition wall 24*a* comparts the terminal-housing chambers 21 in the crosswise direction, and the partition wall 24*b* comparts the terminal-housing chambers 21 in the vertical direction (refer to FIG. 5A). The second inner housing 20 is provided with lances 23 protruding one-to-one to the terminal-housing chambers 21 (refer to FIG. 2).

The second inner housing 20 has a substantially quadrangular block shape identical in size to that of the first inner housing 11, on the rear side thereof and has a cylindrical block shape on the front side thereof. The second inner housing 20 has outer faces in the crosswise direction on the rear side thereof, provided with a pair of lock arms 22. The pair of lock arms 22 protrudes backward.

The front face of the first inner housing 11 comes close so as to abut on the rear face of the second inner housing 20. Then, the pair of lock arms 22 locks together with the pair of locking protrusions 15, so that the first inner housing 11 and the second inner housing 20 are combined. The combination results in a combined inner housing 25 (refer to FIG. 4). The first inner housing 11 and the second inner housing 20 are combined in the longitudinal direction of the twisted cable 1.

When the combined inner housing 25 is viewed from the front side thereof or from the rear side thereof, the four insertion holes 13 are in one-to-one communication with the four terminal-housing chambers 21.

The terminals 7 are inserted one-to-one in the terminal-housing chambers 21 of the combined inner housing 25 through the rear openings. The twist-released sections of the sheathed cables 6 are inserted one-to-one in the insertion holes 13 of the combined inner housing 25 through the rear openings. Each terminal 7 is retained and housed with a locking protrusion 9 thereof locking together with the lance 23 of the terminal-housing chamber 21. In addition, the twist-released section of each sheathed cable 6 is housed in the insertion hole 13.

The sheathed cables 6 of each twisted-pair cable 5 are housed in the crosswise adjacent insertion holes 13, and the terminals 7 are housed in the crosswise adjacent terminal-housing chambers 21.

The shield member 30 has a frame shape similar to the outer shape of the combined inner housing 25. A cylindrical-hollow swage portion 30*a* protruding is provided on the rear end side of the shield member 30. The shield member 30 houses the combined inner housing 25 and the folded portion of the shield braided wire 3. The swage portion 30*a* of the shield member 30 is swaged with the shield braided wire 3 by swaging. The shield braided wire 3 and the shield member 30 are constituents for an electromagnetic shield circuit. Each sheathed cable 6 inside is electromagnetically shielded by the electromagnetic shield circuit from the outside of the twisted cable 1.

The outer housing 40 has a component-housing chamber 41. The shield member 30 in which the combined inner housing 25 is embedded, is housed in the component-housing chamber 41. The outer housing 40 has a rear end portion provided with a rubber-stopper-housing groove 42 opening at the inner circumferential face of the component-housing chamber 41. A ring-shaped rubber stopper 47 is housed in the rubber-stopper-housing groove 42. The rubber stopper 47 compressed and deformed, adheres closely to the entire of the outer circumference of the twisted cable 1. Thus, the rubber stopper 47 prevents, for example, water flowing along the twisted cable 1, from infiltrating into the outer housing 40. The rubber stopper 47 is retained in position by a cover 48 attached to the rear end portion of the outer housing 40.

A mating-connector fitting portion 43 is provided on the front end side of the outer housing 40. A ring-shaped hood portion 45 is provided apart through a connector fitting space 44 from the outer circumference of the mating-connector fitting portion 43. The outer circumferential face of the mating-connector fitting portion 43 is provided with a gasket 46. With a mating connector 49 fit in the outer housing 40 (illustrated with an imaginary outline in FIG. 2), the gasket 46 prevents, for example, water from infiltrating into the combined inner housing 25.

Next, the impedance between the two terminals 7 connected with each twisted-pair cable 5 and the impedance between the two sheathed cables 6 each in the twist-released section in a case where the first inner housing 11 is formed of the first dielectric, will be described. The impedance ZO between conductors between which a dielectric is interposed, can be calculated with the following expression:

$$ZO=(276/\sqrt{\varepsilon})\cdot\{\ln(2P/d)\}$$

where d represents the width of each conductor, P represents the pitch between the adjacent conductors, and s represents the permittivity of the dielectric.

Figure 5A:
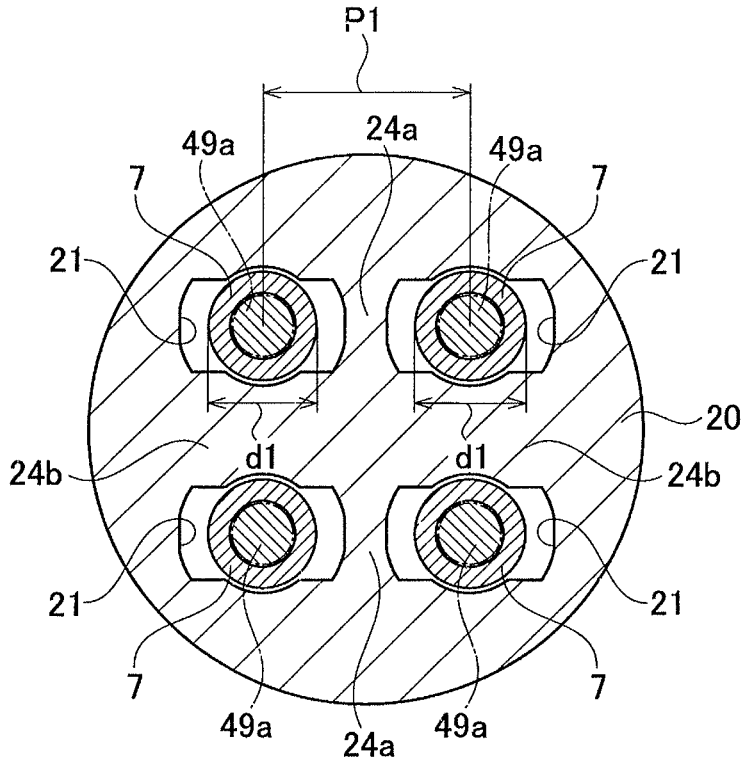
FIG. 5A is a sectional view of terminals having been housed.
Figure 5B:
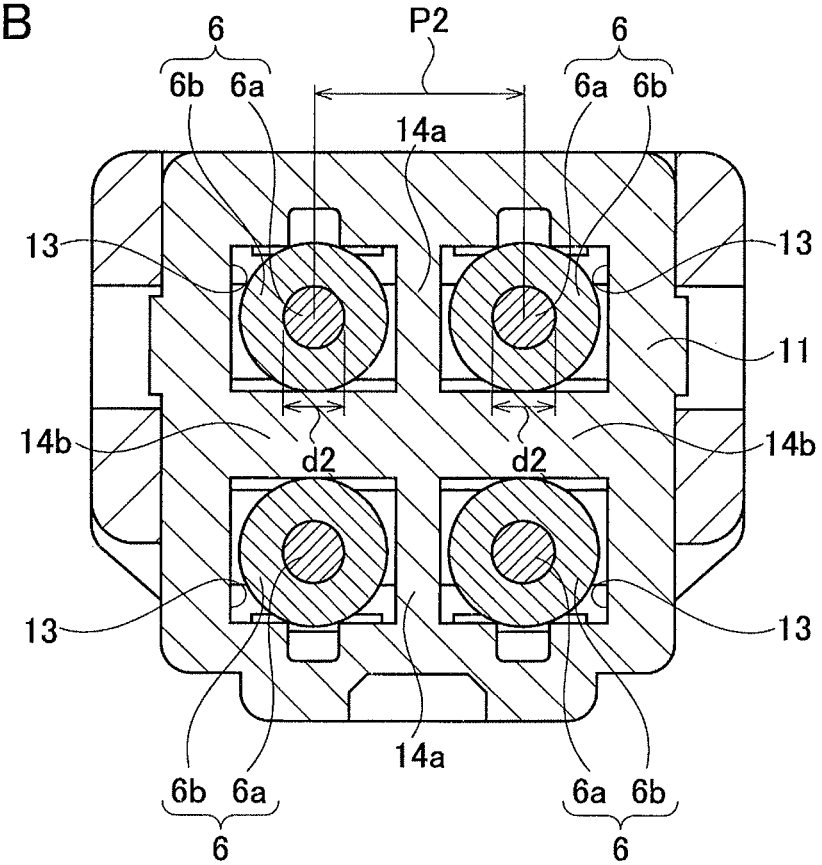
FIG. 5B is a sectional view of sheathed cables having been housed, according to the embodiment of the present disclosure.

According to the present embodiment, as illustrated in FIGS. 5A and 5B, the width d1 of each terminal 7 is larger in size than the width d2 of the core 6*a* of each sheathed cable 6 (d1>d2). The pitch P1 between adjacent terminals 7 is identical in size to the pitch P2 between the cores 6*a* of the adjacent sheathed cables 6 (P1=P2). On the basis of the above expression, the second inner housing 20 and the first inner housing 11 are formed of respective dielectrics different in permittivity such that the impedance between the two terminals 7 is substantially identical in value to the impedance between the two sheathed cables 6 each in the twist-released section. Specifically, the first dielectric of the first inner housing 11 is formed of a material large in permittivity, and the second dielectric of the second inner housing 20 is formed of a material smaller in permittivity than the material of the first dielectric.

That is the pitch P1 between the adjacent terminals 7 is matched in impedance by the second inner housing 20 formed of the second dielectric, and the pitch P2 between the adjacent sheathed cables 6 is matched in impedance by the first inner housing 11 formed of the first dielectric.

As described above, the connector 10 includes the combined inner housing 25 resulting from the first inner housing 11 and the second inner housing 20 in combination. The first inner housing 11 having the plurality of mutually independent insertion holes 13, is formed of the first dielectric or the electric conductor. The second inner housing 20 having the plurality of mutually independent terminal-housing chambers 21, is formed of the second dielectric. The combined inner housing 25 has the plurality of insertion holes 13 in one-to-one communication with the plurality of terminal-housing chambers 21. Each of the ends of the plurality of sheathed cables 6 having the twist released in each twisted-pair cable 5, is connected with the terminal 7. The terminals 7 are inserted one-to-one in the terminal-housing chambers 21 of the combined inner housing 25, and the twist-released sections in which the twists of the sheathed cables 6 are released, are inserted one-to-one in the insertion holes 13 of the combined inner housing 25. Thus, each terminal 7 is housed in the terminal-housing chamber 21, and the twist-released section of each sheathed cable 6 is housed in the insertion hole 13. The combined inner housing 25 is covered with the shield member 30. The combined inner housing 25 and the shield member 30 are housed in the outer housing 40.

Therefore, for cable-housing work, the sheathed cables each connected with the terminal 7 require at least inserting in the mutually independent insertion holes 13 of the combined inner housing 25. Thus, no pinching (catching) of the sheathed cables 6 occurs in the cable-housing work.

In a case where the first inner housing 11 is formed of the first dielectric, the impedance between adjacent terminals 7 and the impedance between the adjacent sheathed cables 6 are matched, respectively, by the second inner housing 20 and the first inner housing 11 varied in permittivity. Therefore, a signal waveform can be transmitted with higher fidelity in a transmission channel, with reduction of waveform distortion resulting from reflected waves.

Note that, according to the embodiment, the twisted cable 1 has the two twisted-pair cables 5. However, the present disclosure can be applied to even a twisted cable having one twisted-pair cable or a twisted cable having three twisted-pair cables or more.

What is claimed is:

1. A connector comprising:

a combined inner housing formed of a first inner housing and a second inner housing in combination, the first inner housing having a plurality of insertion holes mutually independent from each other, the first inner housing being formed of a first dielectric or an electric conductor, the second inner housing having a plurality of terminal-housing chambers mutually independent from each other, the second inner housing being formed of a second dielectric, the plurality of insertion holes of the first inner housing being in one-to-one communication with the plurality of terminal-housing chambers of the second inner housing;

a twisted-pair cable having a plurality of sheathed cables, each sheathed cable having a twist thereof released, and each sheathed cable of the plurality of sheathed cables having an end thereof connected with a terminal, the plurality of terminals being housed one-to-one in the plurality of terminal-housing chambers of the second inner housing by one-to-one insertion of the plurality of terminals in the terminal-housing chambers of the second inner housing, twist released sections of the respective plurality of sheathed cables, in which the twists of the respective plurality of sheathed cables are released, being housed one-to-one in the insertion holes of the first inner housing by one-to-one insertion of the twist-released sections of the plurality of sheathed cables in the insertion holes of the first inner housing;

a shield member that covers the combined inner housing; and an outer housing that houses the combined inner housing and the shield member.

2. The connector according to claim 1, wherein the first dielectric of the first inner housing is formed of a material having a relatively large permittivity, and the second dielectric of the second inner housing is formed of a material having a smaller permittivity than the material of the first dielectric, and a pitch between terminals mutually adjacent to each other, of the plurality of terminals, is matched in impedance by the second inner housing formed of the second dielectric, and a pitch between sheathed cables mutually adjacent to each other, of the plurality of sheathed cables, is matched in impedance by the first inner housing formed of the first dielectric.

3. The connector according to claim 2, wherein widths of each terminal of the plurality of terminals are larger in size than widths of cores of sheathed cables of the plurality of sheathed cables, and the pitch between the terminals mutually adjacent to each other is identical in size to the pitch between the sheathed cables mutually adjacent to each other.

4. The connector according to claim 3, wherein the permittivity of the first dielectric and the permittivity of the second dielectric are configured such that the impedance between the terminals mutually adjacent to each other is substantially identical to the impedance between the sheathed cables mutually adjacent to each other, in the twist-released sections.

* * * * *